United States Patent [19]

Murase

[11] 3,994,146

[45] Nov. 30, 1976

[54] APPARATUS APPLYING DYESTUFFS SUBLIMATED UNDER REDUCED PRESSURE

[75] Inventor: Yasuhiko Murase, Tokyo, Japan

[73] Assignee: Toyo Ink Manufacturing Co., Ltd., Tokyo, Japan

[22] Filed: Apr. 7, 1975

[21] Appl. No.: 565,442

[30] Foreign Application Priority Data

Apr. 11, 1974 Japan ..... 49-40422
Apr. 11, 1974 Japan ..... 49-40423

[52] U.S. Cl. ..... 68/5 C; 68/8; 68/85; 101/470

[51] Int. Cl.² ..... D06P 1/00; B41C 1/06

[58] Field of Search ..... 68/5 C, 8, 85; 101/470

[56] References Cited

UNITED STATES PATENTS

| | | | |
|---|---|---|---|
| 441,946 | 12/1890 | Drown | 68/8 |
| 2,501,495 | 3/1950 | Carroll et al. | 101/470 |
| 2,594,290 | 4/1952 | Chavannes | 154/97.5 |
| 2,616,961 | 11/1952 | Groak | 101/128.4 X |
| 2,651,992 | 9/1953 | Sauberlich | 101/426 X |
| 2,710,574 | 6/1955 | Runion | 101/350 X |
| 3,788,106 | 1/1974 | True | 101/470 X |
| 3,860,388 | 1/1975 | Haigh | 101/467 |

FOREIGN PATENTS OR APPLICATIONS

| | | | |
|---|---|---|---|
| 1,227,681 | 4/1971 | United Kingdom | |
| 2,679 | 1857 | United Kingdom | 101/426 |
| 491 | 1852 | United Kingdom | 101/426 |

OTHER PUBLICATIONS

Textile Month, July 1973, Transfer Printing, pp. 73, 75, 78.

Textile Month; Aug. 1972, pp. 28, 29; Improvements to Transfer Printing Technique from ICI.

JSDC; Dec. 1973; pp. 474–485; Possibilities of Vacuum Technology; Ward.

*Primary Examiner*—Clyde I. Coughenour
*Attorney, Agent, or Firm*—Frank J. Jordan

[57] ABSTRACT

Apparatus for applying dyestuffs to textile materials by transfer of the dyestuffs sublimated at reduced pressure, characterized in that it comprises a cooling roll for cooling heated, printed or dyed material to temperatures lower than its secondary transition point and, if desired, further comprises at least one of a preheating roll for lessening the temperature gradient between the surface and reverse sides of the textile material to be printed when transfer printing is effected on a heating roll, a brushing roll for remedying deformed, printed textile material and a means for controlling the feeding rates of a transfer printing paper and a backing paper with respect to each other thereby to minimize the difference in peripheral velocity on the heating roll between the printing paper and backing paper.

1 Claim, 11 Drawing Figures

5

5

APPARATUS APPLYING DYESTUFFS SUBLIMATED UNDER REDUCED PRESSURE

This invention relates to a reduced-pressure sublimation transfer printing apparatus and more particularly to an apparatus for applying dyestuffs to textile materials by sublimating and transferring the dyestuffs thereto under reduced pressure using a transfer printing method.

Heretofore, in the practice of transfer printing using conventional transfer printing apparatuses, textile material to be printed and transfer printing paper after having overlapped each other are, in most cases, heated under pressure in the atmosphere to thereby print the textile material. In such a case the heating temperature and the pressure necessary for the transfer printing have to be made high because the dyestuffs from the transfer printing paper will otherwise be unsatisfactorily deeply impregnated into the textile material when such conventional apparatuses are used. Thus the conventional apparatuses are disadvantageous in that the kinds of textile materials which may be satisfactorily printed with the dyestuffs thereby are limited and, in addition, the textile materials so printed at the high temperature and pressure are deteriorated in handling and touch, this being a vital drawback for textile materials. On the other hand, there have recently been developed reduced-pressure sublimation transfer printing apparatuses which eliminate such drawbacks and allow the use of lower temperatures and pressures in effecting transfer printing under a vacuum or reduced pressure of not higher than 100 mm. of mercury. When employed these developed apparatuses make it possible to dye textile materials by transferring thereto the dyestuffs from transfer printing paper without being subjected to such high pressures at the time of transfer printing as used when the conventional apparatuses are employed and, therefore, they also make it possible to effect transfer printing even on pilous fabrics and thick knitted or woven fabrics having an uneven surface without causing deformations such as surface flattening of these fabrics and deterioration thereof in handling and touch. The developed apparatuses are thus very effective in efficiently producing satisfactory printed products from thick and/or readily deformable knitted or woven textile materials, while they raised various problems which have been out of the question or no troubles in the practice of the conventional methods for thermal transfer printing at atmospheric pressure.

More particularly, in the conventional methods for thermal transfer printing at atmospheric pressure, printed or dyed textile materials are very often allowed to cool before being taken up on take-up rolls, while those which require to be forcibly cooled are cooled in a cool air-cooling step set up subsequent to the transfer printing step before recovered on rubber-made take-up rolls. If the printed textile materials which need forcible cooling are insufficiently cooled in the cooling step, the deformed portions thereof if any will be heat set when taken up on the rolls thereby creating permanent deformation; for example, if the printed pilous textile materials with the piles pushed down in a certain direction therein or creases incidentally created therein are taken up on the take-up rolls then the pushed-down piles and the thus-created creases will disadvantageously be heat set when the textile materials are taken up on the rolls and, in worst cases, when the textile materials are wound around the take-up rolls, the dyestuffs applied to a portion of the dyed textile material will partly be impregnated into the reverse side of another portion thereof overlapped just on the former portion thereby staining the reverse side of the latter with the dyestuffs.

On the other hand, in the reduced-pressure sublimation transfer printing apparatus of this invention wherein the transfer printing is effected at a highly reduced pressure of not more than 100 mm. of mercury thereby requiring an air-tight evacuated chamber for housing the apparatus therein as shown in the accompanying drawings, there have to be performed in such air-tight vacuum chamber all the operations such as feeding of each textile material to be printed or dyed, transfer printing paper and backing paper therefor, from a feeding roll, heating of the textile material by a heating roll and conduct of transfer printing thereon, cooling of the printed or dyed textile material by a cooling roll, and recovery of each of the printed textile material, used transfer printing paper and used backing paper on a take-up roll. The operations also include preliminary heating by a pre-heating roll, brushing of the printed textile material by a brushing roll, and adjustment of a ratio between the feeding rate of the transfer printing paper and that of the backing paper in the case that these rolls are additionally used and the ratio adjustment operation is also performed as required in the apparatus of this invention. The evacuated chamber requires higher strength in material from which it is fabricated as it is larger in capacity or volume and, thus, provision of large such chamber is likely to be technically and economically burdensome to manufacturers of reduced-pressure transfer printed textile materials.

Under the conditions that such evacuated or vacuum chamber must be employed, it is impossible to cool the heated, printed textile material with cooling air as used as the cooling system in the conventional processes.

As a result of his studies made in attempts to solve such problem, it has been found by the present inventor that satisfactory cooling may be effected on the heated, printed textile material by the provision of a cooling roll made of a good heat-conductive material such as a metal in the apparatus of this invention, and that more satisfactory cooling and minimization of the evacuated chamber in volume will be attained if the take-up roll for the printed textile material is further designed to be additionally used as a cooling roller for further cooling the printed textile material.

For illustration only, apparatuses which are preferred embodiments of this invention will now be described, with reference to the accompanying drawings in which.

Figure 8:
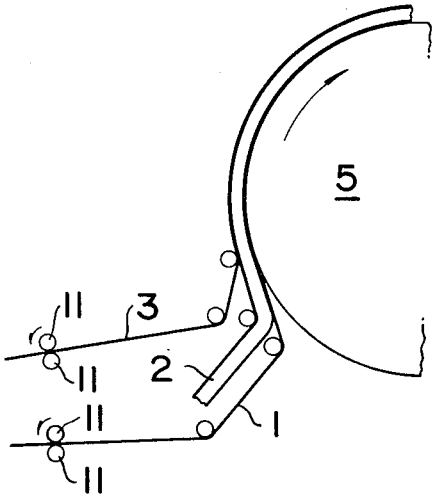
Figure 9:
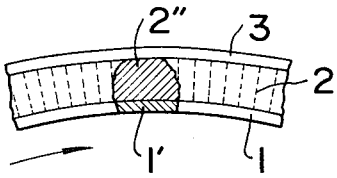

FIG. 8 is a cross-sectional view showing the state of feeding such a pilous or thick textile material to be dyed by transfer printing, sublimation transfer printing paper and backing paper onto the heated surface of the roll portion of the heating roll while adjusting a ratio between the feeding rate of the transfer printing paper and that of the backing paper in one embodiment of this invention; and FIG. 9 is a cross-sectional view showing the state of the pilous or thick textile material being thermally dyed on the heated surface of the roll portion of the heating roll in the embodiment indicated in FIG. 8.

Figure 1:
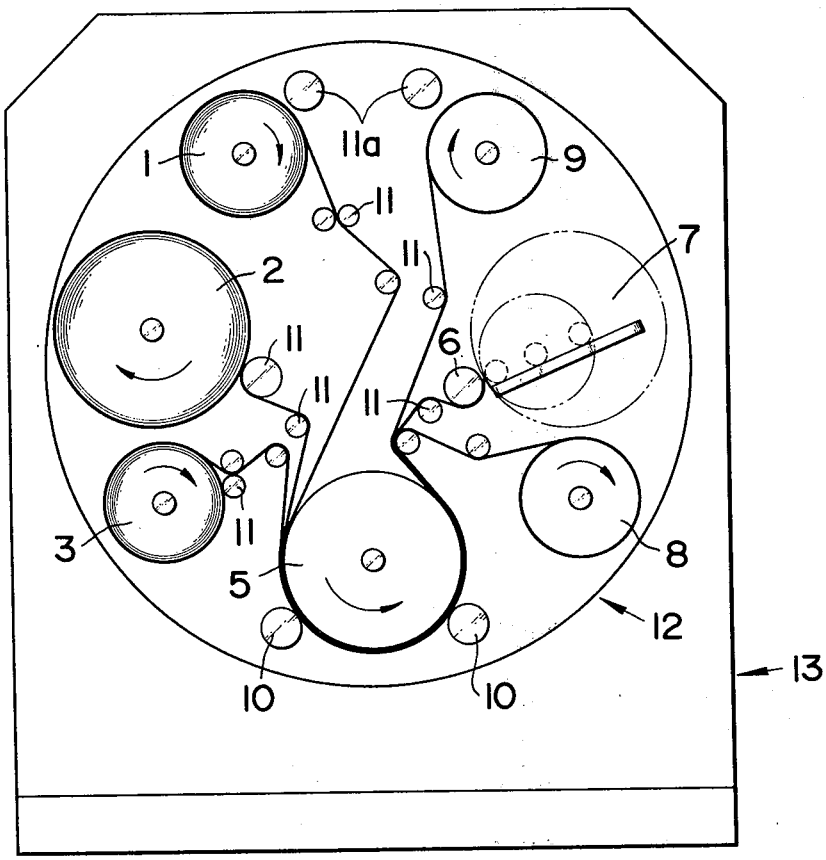
FIG. 1(A) is a diagrammatic view of the longitudinal cross-section of one embodiment of the apparatus and FIG. 1(B) is that of another embodiment of the apparatus.

Referring now particularly to FIGS. 1(A) and 1(B), the apparatus of this invention comprises a roll 1 for feeding transfer printing paper, a roll 2 for feeding textile material to be printed or dyed, a roll 3 for feeding backing paper for the textile material, a roll 5 for heating and allowing thereon slight pressurization of the three fed materials with the textile material being sandwiched in between the transfer printing paper directly contacting the heated surface of the roll portion of the heating roll 5 and the backing paper, thus printing or dyeing the textile material by transfer printing technique, a cooling roll 6 for cooling the heated, printed textile material, a take-up roll 7 for taking up the cooled, printed textile material thereon, the roll 7 being preferably designed to be additionally used as a cooling roll, a take-up roll 8 for taking up the used backing paper thereon, a take-up roll 9 for taking up the used transfer printing paper thereon, the whole of the apparatus being housed in an evacuated chamber 12 enclosed in a case 13. As shown in the embodiment of FIG. 1(B), the apparatus may further comprise at least one of a pre-heating roll 4 for pre-heating the transfer printing paper, the textile material, and the backing paper, and a brushing roll 25 for remedying the deformation of the printed textile material. Also there may be provided means for controlling (not shown) a ratio between the feeding rates of the transfer printing paper and backing paper.

Figure 2:
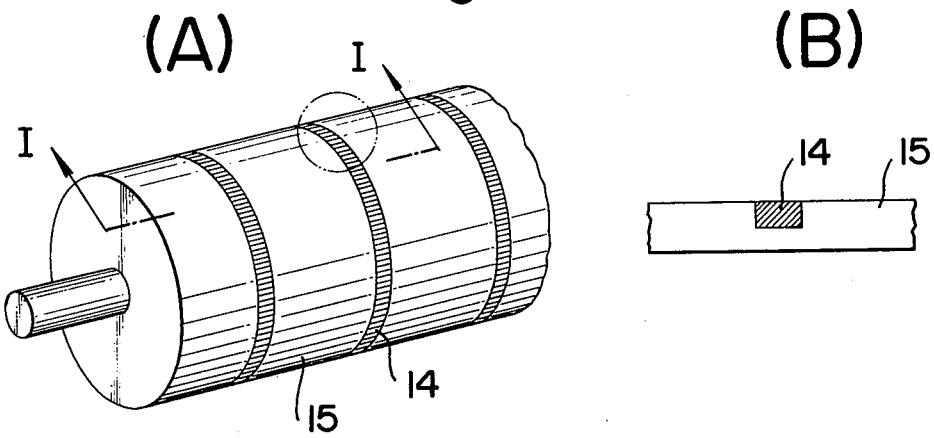
FIG. 2(A) is a perspective view of a cooling roll included as one of the component units in the apparatus and FIG. 2(B) is a fragmentary cross-sectional view of the roll portion of the cooling roll taken on line I—I of FIG. 2(A)
Figure 1:
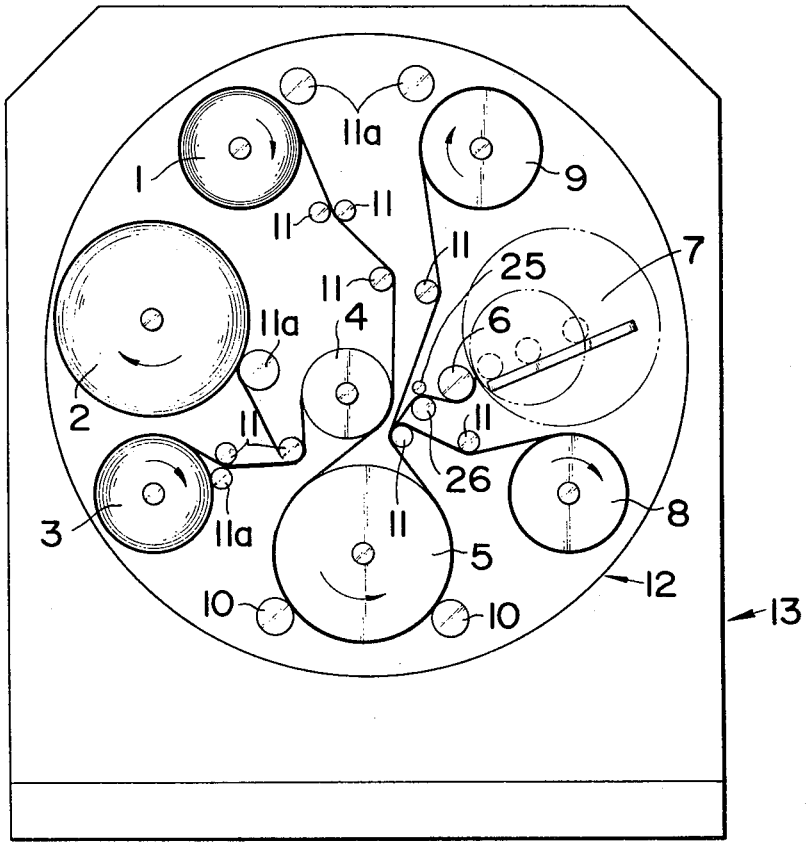

With reference to FIGS. 1(A) and 1(B) again, it should particularly be noted how the cooling roll 6 functions in the apparatus. The heated, printed textile material from the heating roll 5 on which the transfer printing is effected, is passed onto the cooling roll 6 to cool it thereon and continuously passed to the take-up roll 7. The take-up roll 7 allows the continuously incoming cooled printed textile material to be wound around it whereby the layer of the printed textile material formed on the roll 7 gradually grows thick and is therefore gradually enlarged in outer diameter due to the cumulative layer formation from the continuously incoming printed textile material. Thus, the take-up roll 7 is designed to be gradually movable as the layer of the printed textile material grows thicker, in the direction opposite to the roll 6 and perpendicular to the line passing tangentially with respect to both the cooling roll 6 and the growing layer of the printed textile material and through the contact point at which the roller 6 and the growing layer contact each other, while allowing the incoming printed textile material from the roll 5 to pass through said contact point between the cooling roll 6 and the growing layer towards the roll 7. In this case, the printed textile material from the heating roll 5 is passed through the cooling roll to the take-up roll 7 by means of the pulling force produced by power driving the cooling roll 6 to rotate in pressure contact with the growing layer of the cooled printed textile material while allowing the heated printed textile material from the roll 5 to pass therebetween through said contact point. It is thus desirable that the cooling roll should have a roll surface of a high frictional coefficient in order to facilitate the printed textile material from the roll 5 to be taken up on the roll 7. To this end, the cooling roll 6 should not allow the printed textile material from the roll 5 to slip on the surface. In view of this, the cooling roll 6 may preferably be roughened on the surface as by sand blasting the surface, etching the surface, which action is milder than that of sand blasting, cutting the surface of the roll, usually metallic, to form therein a few grooves in which rubber material is snugly buried, or the like in order to enhance the surface of the roll 6 in frictional coefficient to the extent that the surface of the roll 6 is not appreciably lowered in thermal conductivity. FIGS. 2(A) and 2(B) show an example of such a metallic cooling roll having rubber material 14 snugly buried in the grooves formed on the surface 15 thereof.

Figure 3:
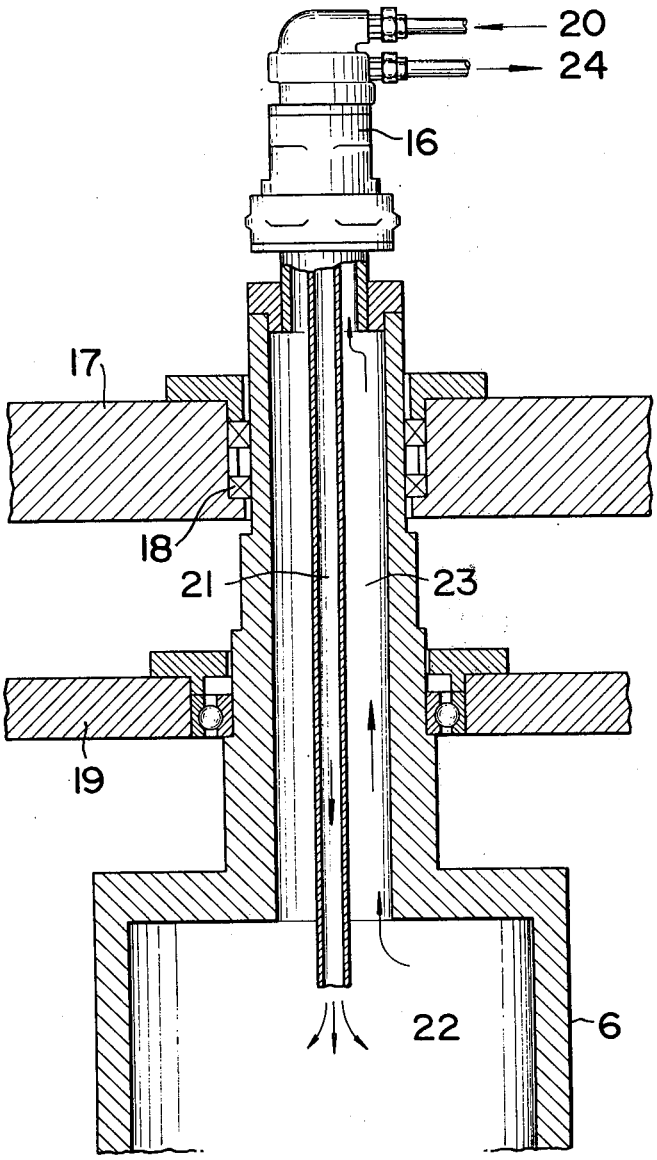
FIG. 3 is a fragmentary cross-sectional view of the cooling roll.

The cooling roll 6 is used to lower the temperature of the heated printed textile material thereon to temperatures not higher than the secondary or glass transition point thereof and, therefore, it is necessary to keep the surface of the roll portion of the cooling roll 6 at as low temperatures as possible as by circulating cooling water or air through within the roll as indicated in FIG. 3 showing a fragmentary cross-sectional view of an example of the cooling roll. In this Figure, the cooling roll 6 side is partitioned or defined from a pressure rotary joint side 16 by a base plate 17 so that the former is kept in vacuo and the latter at atmospheric pressure with aid of oil seals 18 as air-tight means. Numeral 19 designates a side plate in the vacuum system. Cooling water is passed through an inlet pipe 20, a pipe 21 provided in the hollow axis of the cooling roll 6 and the inner side 22 thereof and further through the inner side of 23 of the cooling roll to an outlet pipe 24 from which the used cooling water is discharged.

In another embodiment, the apparatus of this invention may preferably further comprise a pre-heating roll for the following reasons. In carrying out reduced-pressure sublimation transfer printing at a reduced pressure of not more than 100 mm. of mercury, the dyestuffs contained in the transfer printing paper sublimate remarkably rapidly as compared with those sublimated at atmospheric pressure in the conventional processes and they are rapidly applied to, impregnated and diffused into, the textile material in high concentrations and to the depth thereof. This makes it possible to effect satisfactory transfer printing on thick textile materials or easily deformable knitted or woven ones by contacting the textile material with the transfer printing paper under a very low contacting pressure, that is by "kiss touch" which is quite unsuitable for the conventional transfer printing at atmospheric pressure, when the transfer printing is carried out. However, as the contacting pressure used is lower at the time of transfer printing the margin of the pattern or design transferred to the textile material is very likely to be more indefinite or unclear by the diffusion of the transferred dyestuffs thereby impairing the sharpness of the transferred design. More particularly, since the transfer printing paper and the textile material to be printed are not so closely contacted each other as in the conventional processes, the dyestuffs are diffused and impregnated into the textile material not only in the vertical direction thereof but also in the direction parallel to the transfer printing paper thus incurring such troubles as mentioned above. When extremely thick textile materials such as highly pilous ones are subjected to transfer printing, the dyestuffs from the transfer printing paper will be diffused and impregnated into the textile material in higher concentrations in the inner portion thereof than in the surface portion thereof in the practice of the reduced-pressure sublimation transfer printing process. Thus, despite the fact that the textile material has actually been impregnated and dyed with sufficient amounts of the dyestuffs transferred from the transfer printing paper, the dyed textile material when the surface thereof is visually viewed will appear as if it were a non-dyed one, this being caused by so-called "frost effect" which is a characteristic phenomenon occurring in the reduced-pressure sublimation transfer printing process. The reason for this is considered as follows:

When a textile material the temperature of which is equal to that of the atmosphere is just subjected to reduced-pressure sublimation transfer printing on a heating plate or roll, the temperature of the surface side of the textile material is raised nearly to that of the heating plate or roll while that of the reverse side thereof is not so raised thereby making a great difference in temperature between the surface and reverse sides, that is, forming a great temperature gradient therebetween. (This is remarkable with thick textile materials.) Therefore, the dyestuffs transferred from the transfer printing paper to the textile material by sublimation are diffused into the high molecular chains in the non-crystalline region of the melted and softened surface portion of the textile material whereby they are diffused in the surface portion at higher temperatures rather than are impregnated and diffused deep into the inner portion of the textile material. As a consequence, the design or pattern is transferred to the textile material where it is not sharply reproduced thus obtaining a transferred design or pattern with the margin being indefinite. The "frost effect" experienced with highly pilous textile material is considered to be caused by the fact that the dyestuffs from the transfer printing paper are present in higher concentrations in the lower portion of the piles of the pilous textile material than in the top or upper portion thereof since the dyestuffs applied to the top or upper portion is then impregnated and diffused deep into the interior of the textile material by the impetus caused by a great temperature gradient between the surface and reverse sides of the pilous textile material.

It has been found by the present inventor that these drawbacks which are characteristic of the reduced-pressure sublimation transfer printing particularly when effected on thick textile materials, are substantially eliminated by provision of pre-heating means such as a hot air dryer, heating roll or heating plate upstream of the heating roll on which transfer printing is effected, thereby to minimize the temperature gradient between the surface side and the reverse side of the textile material at the time of transfer printing.

In a still another embodiment, the apparatus of this invention may preferably further comprise a brushing roll without or in addition to said pre-heating roll. As previously mentioned, the reduced-pressure sublimation transfer printing process makes it possible to dye pilous textile materials or thick knitted or woven ones by transferring thereto the dyestuffs by sublimation thereof without considerably deforming or flattening the pilous or thick textile materials as compared with the conventional transfer printing processes effected at atmospheric pressure. It is preferable, however, that even the process according to this invention should comprise means for remedying the deformation or flattening of the printed textile material in order to obtain more excellently finished, printed textile materials. It has been found by the present inventor that this is realized by the provision of a brushing roll as the remedying means downstream of the heating roll on which transfer printing is effected and preferably upstream of the cooling roll. The positioning of the brushing roll as mentioned above is reasonable since the remedy (such as raising the lying-down piles upright) should preferably be carried out on the printed textile materials to be remedied. Means for remedying the deformed, printed textile materials which may be used in the evacuated chamber the inner volume of which is limited in size from the technical and economical points of view, are required to need as small a space for its installation as possible and to be capable of continuous operation; thus, it has been found by the present inventor that the brushing roll is very suitable as the remedying means and it should be capable of rotating, in the same direction as that in which the textile material proceeds, at a peripheral speed higher than the moving speed of the printed textile material to be remedied and should be positioned necessarily downstream of the heating roll and preferably upstream of the cooling roll in order to attain maximum remedy effects, since the remedy is desirable to effect before the printed textile material to be remedied is lowered in temperature to lower than its secondary transition point or glass transition point and the remedied textile material is desirable to cool to lower than its secondary transition point thereby preventing deformation or flattening of the already remedied textile material from occurring again.

It is generally possible to remedy the deformed printed textile material while it is kept at temperatures not lower than its secondary transition point only by the provision of the brushing roll just downstream of the heating roll. To this end, however, a metal- or plastics-made brushing roll and a mating idler roll may be used and one or both of them may be heated on the roll surface to temperatures that are not lower than the secondary transition point of the textile material and not higher than temperatures at which the transfer printing is carried out, if desired.

Figure 4:
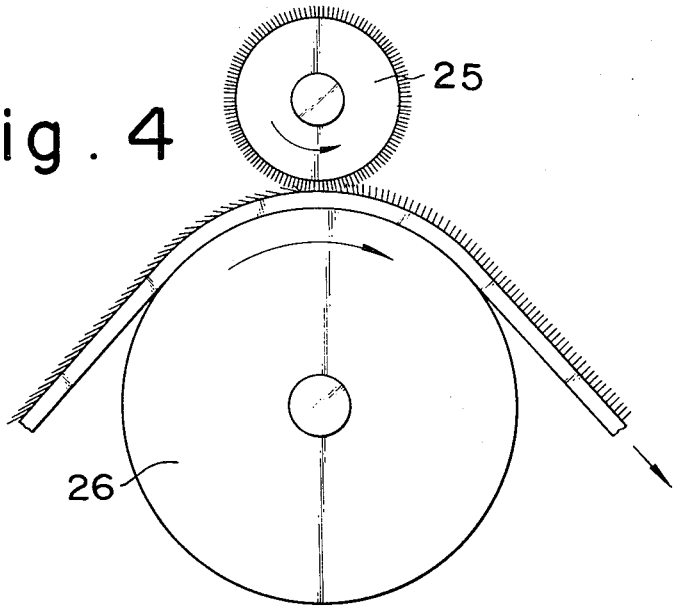
FIG. 4 is a side view of a brushing roll and an idling roll in cooperation therewith both of which may be among the component units of the apparatus.

It is necessary that the brushing roll should be rotated, in the same direction as the textile material is moved, at a peripheral velocity higher than the moving velocity of the textile material as shown in FIG. 4. The rotation speed of the brushing roll can be varied and should be varied depending upon parameters such as the kind of a textile material to be printed by dye transfer and the transfer printing speed selected.

Typical of brushing rolls which may be used herein are metallic or plastic rolls on which resilient plastic fibers (such as polyvinylidene chloride fibers) or animal hairs of a predetermined length are fixed at one end, and rolls on which a number of narrow baffle plates are fixed in parallel to the axis of the roll as in a water mill. As a brush fixed on the brushing roll a metallic brush may be used; however, the metallic fibers of such brush, prior to use thereof, should be treated, for example, should be somewhat rounded at the tip thereby to avoid injuring the printed textile material.

In a still further embodiment of this invention, the apparatus of this invention may further comprise means for controlling a ratio between the feeding rates of the transfer printing paper and the backing paper so that the peripheral speeds of these papers are substantially equal to each other on the heating roll thereby avoiding the formation of transferred design or pattern deformed due to discrepancy of peripheral speed between said two papers particularly when the textile material to be printed is a thick one such as carpet.

Figure 5:
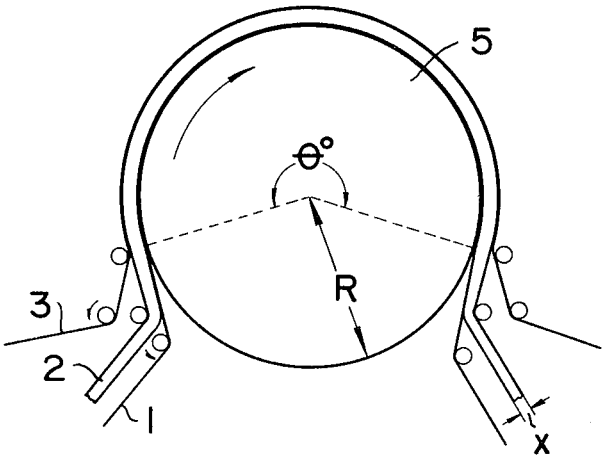
FIG. 5 is a cross-sectional view showing the state of a pilous or thick knitted or woven textile material being dyed by a conventional transfer printing technique on a heating roll.
Figure 6:
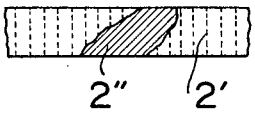
FIG. 6 is a cross-sectional view of the state of the pilous or thick textile material being dyed by the conventional transfer printing technique thereby showing a drawback thereof due to falling down of the piles of the pilous textile material or distortion of the thick knitted or woven textile material.
Figure 7:
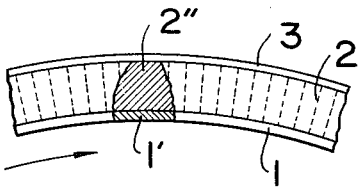
FIG. 7 is a cross-sectional view of the state of the pilous or thick textile materials being dyed on the heated surface of the roll portion of the heating roll, thereby also showing the drawback of the conventional technique.

The means for controlling the peripheral speeds of the printing and backing papers on the heating roll with respect to each other will now be described by reference to FIG. 5. The transfer printing paper 1, textile material 2 to be printed, and backing paper 3 are passed in stacked relationship onto the heating roll 5 where the material 2 is printed with the dyestuffs transferred from the paper 1 by sublimation of the dyestuffs under reduced pressure. Assuming that the radius of the heating roll 5 be R, the thickness of the textile material 2 be $x$, the angle over which the textile material 2 is contacted with the surface of the heating roll 5 be $\theta°$ and the thickness of the papers 1 and 3 be neglected, the backing paper 3 is supposed to proceed over a distance of $2\pi(R+x)\times\theta/360$ on the heating roll 5 while the transfer printing paper 1 proceeds over a distance of $2\rho R\times\theta/360$ on the same roll 5. Thus, if the feeding rates or speeds for the two papers 1 and 3 are equal to each other, the paper 3 will be torn off or a deformed transferred design 2'' will be obtained as shown in FIG. 6 thereby remarkably decreasing the printed textile material in commercial value. More particularly, as shown in FIG. 9, if the papers 1 and 3 are fed at the same feeding rate, the portion of the to-be-printed textile material 2 near to the surface of the heating roll 5 will precede the portion of the textile material 2 far from the surface thereof thereby causing such troubles as mentioned above.

According to this invention, such troubles are eliminated by further including in the reduced-pressure sublimation transfer printing process means for respectively feeding the transfer printing paper 1 and backing paper 3 at feeding speeds the ratio between which is $R:(R+x)$ wherein R indicates the radius of the heating roll 5 and $x$ the thickness of the textile material to be printed, in the same unit. By the application of said means for controlling the feed rates for the papers 1 and 3 to the present process, no discrepancy in peripheral speed on the heating roll between the two papers 1 and 3 is found thereby avoiding the distortion of the to-be-printed textile material 2 and the tearing-off of the backing paper 3 as shown in FIG. 9. In FIGS. 6 to 9, numerals 1', 2' and 2'' indicate the transfer printing paper portion in which the dyestuffs capable of sublimation is contained, the textile material portion dyed according to the conventional process and the textile material portion dyed according to the invention, respectively.

This invention, in a few embodiments, will be described by the following non-limitative Examples with reference to FIGS. 1 to 9.

EXAMPLE 1

FIG. 1(A) shows an embodiment of an apparatus for carrying out continuous sublimation transfer printing under reduced pressure, the apparatus being wholly housed in an evacuated chamber 12 enclosed in a case 13. Numerals 1, 2 and 3 designate a roll for feeding transfer printing paper, a roll for feeding textile material to be printed and a roll for feeding backing paper for the textile material, respectively. Numeral 5 designates a heating roll which will heat the textile material to from about 130° to about 250° C (at a pressure of not more than 100 mm. of mercury) and on which the transfer printing is effected under heat. After the completion of the transfer printing on the heating roll 5, the used transfer printing paper, printed textile material and used backing paper so far together closely contacted are separated from one another; the printed textile material is put under tension by being pulled to the cooling roll 6 by the rotation thereof and is passed through the roll 6 to a take-up roll 7 on which it is taken up, the used backing paper is passed to a take-up roll 8 for the recovery thereof, and the used transfer printing paper is passed to a take-up roll 9 for the recovery thereof.

EXAMPLE 2

A white art paper having a weight of 70 g/cm$^2$ was printed, using a rotary screen printing technique, with a 10% resin-containing silk screen ink comprising 2 parts by weight of Sumikalon Blue-E-BR (CI Disperse Blue 26 produced by Sumitomo Chemical Industrial Co., Ltd.), 6.4 parts by weight of Sumikalon Yellow-E-4 GL (CI Disperse Yellow 51 produced by Sumitomo Industrial Co., Ltd.) and 1.6 parts by weight of Micheton Polyester Yellow-YL (CI Disperse Yellow 42 produced by Mitsui Toatsu Chemical Industrial Co., Ltd.) to form transfer printing paper. The transfer printing paper so formed was fitted on the feeding roll 1, a 500 m long highly pilous polyester-made textile material fitted on the feeding roll 2 and a backing paper fitted on the feeding roll 3, as shown in FIG. 1(A). In the evacuated chamber kept at an initial reduced pressure of 15 Torr, an experiment was made as follows:

The three materials respectively fed from the feeding rolls 1 to 3 were arranged in stacked relationship with the textile material being sandwiched in between the backing paper and transfer printing paper, passed onto the heating roll at 190° C where the transfer printing paper of the stacked three materials was directly contacted with the heating roll 5 for 40 seconds to heat and print or dye the textile material by transfer printing, and thereafter were separated from one another. The printed textile material so separated was then passed onto the cooling roll 6 having an etched surface where the printed textile material was contacted with the cooling roll for 10 seconds and passed to the take-up roll 7. The temperature of the printed, highly pilous polyester textile material after taken up on the roll 7, was 38° C thereby facilitating the deformed or lying-down piles of the printed textile material to be satisfactorily recovered to the original, substantially upright form without such deformation being heat set and also avoiding the staining of one portion of the printed textile by unnecessary further impregnation of the dyestuffs from another portion thereof to said portion.

For comparison, another experiment was carried out by following the procedure of the aforementioned experiment except that no cooling water was passed through within the cooling roll. The results are that the temperature of the printed highly pilous polyester textile material taken up on the roll 7 was 80° C thereby heat setting the deformed or lying-down piles of the printed textile material as they were, resulting in poor recovery of the deformed piles to their original form.

EXAMPLE 3

The pre-heating roll 4 is indicated in FIG. 1(B). The pre-heating roll 4 may be substituted by other pre-heating means such as a hot air furnace or heating plates; however, a roll-type pre-heating means, that is the roll 4, is conveniently used since the apparatus of this invention is a continuously-operated one. The roll 4 is heated to about 60 – about 150° C so that the textile material being printed from the roll 4 has been preliminarily heated to about 60 – about 100° C.

The transfer printing paper 1, textile material being printed 2 and backing paper 3 fed from their respective rollers are passed in stacked relationship onto the pre-heating roll 4 heated at about 60 – about 150° C where the textile material 2 is pre-heated to about 60 – about 100° C and then onto the heating roll 5 on which the textile material is printed at about 130 – about 250° C with dyestuffs transferred from the transfer printing paper 1 by sublimation. Numeral 10 designates a pressure roll used as required. The subsequent procedure is the same as in Example 1. The transfer printing paper 1, textile material 2 and backing paper 3 can controllably be put under suitable tension by means of guide rolls 11 provided respectively for the three materials 1 to 3.

EXAMPLE 4

By using a rotary press, a white art paper having a weight of 70 g/m² was screen printed with a 10% resin-containing silk screen ink comprising 2 parts by weight of Sumikalon Blue-E-BR (CI Disperse Blue 26 produced by Sumitomo Chemical Industrial Co., Ltd.), 6.4 parts by weight of Sumikalon Yellow-E-4 GL (CI Disperse Yellow 54 produced by Sumitomo Chemical Industrial Co., Ltd.) and 1.6 parts by weight of Micheton Polyester Yellow-YL (CI Disperse Yellow 42 produced by Mitsui Toatsu Chemical Industrial Co., Ltd.), thereby to obtain a transfer printing paper on which line-formed designs having a 1.3 mm width were printed at intervals of 1 cm. The printing paper so obtained was fitted on the feeding roll 1 described in Example 3, an acrylic resin-made textile material 2 was fitted on the feeding roll 2 and the backing paper 3 was fitted on the feeding roll 3 in the evacuated chamber 12 at an initial reduced pressure of 15 Torr. The printing paper 1, textile material 2 and backing paper 3 fed from their respective feeding rolls were passed in stacked relationship onto the pre-heating roll 4 at 80° C where the textile material 2 is heated for 20 seconds, and then passed onto the heating roll 5 at 160° C on which the pre-heated textile material was heated for 40 seconds during which it was printed by dye transfer technique.

For comparison, the same procedure as above was followed except that the pre-heating step was omitted. The results are that the printed textile material obtained without pre-heating of the textile material to be printed exhibited much of unnecessary diffusion of the dyestuffs out of the transferred design as compared with that obtained without omitting the pre-heating and also exhibited the transferred line-formed designs which were made greater in width than the original ones printed on the transfer printing paper as indicated below.

| | |
|---|---|
| Width of the original line designs on the transfer printing paper | 1.30 mm |
| Width of line designs transferred without pre-heating | 2.40 mm |
| Width of line designs transferred with use of pre-heating | 1.95 mm |

EXAMPLE 5

For comparison, two experiments were made by following the procedure of Example 4 except that the acrylic resin-made textile material was replaced by a polyester Jersey textile material, one experiment including the pre-heating step and the other excluding such pre-heating step. The results are shown below.

| | |
|---|---|
| Width of line designs on the transfer printing paper | 1.30 mm |
| Width of line designs transferred without pre-heating | 2.20 mm |
| Width of line designs transferred with use of pre-heating | 1.75 mm |

EXAMPLE 6

In this Example, there was employed the transfer printing apparatus including the brushing roll 25 and a mating idler roll 26 as shown in FIG. 4.

By using a rotary screen press, a white art paper having a weight of 70 g/m² was printed with a 10% resin-containing silk screen ink comprising 2 parts by weight of Sumikalon Blue-E-BR (CI Disperse Blue 26 produced by Sumitomo Chemical Industrial Co., Ltd.), 6.4 parts by weight of Sumikalon Yellow-E-4 GL (CI Disperse Yellow 51 produced by Sumitomo Chemical Industrial Co., Ltd.) and 1.6 parts by weight of Micheton Polyester Yellow-YL (CI Disperse Yellow 42 produced by Mitsui Toatsu Chemical Industrial Co., Ltd.), thereby to obtain a transfer printing paper. The transfer printing paper 1 so obtained was fitted on the feeding roll 1 as shown in FIG. 1(B), a 200 mm long highly pilous polyester textile material 2 having 5 mm long piles on the feeding roll 2 and the backing paper 3 on the feeding roll 3 in the evacuated chamber 12 at an initial reduced pressure of 15 Torr. The three materials 1 to 3 fed from their respective feeding rolls were passed in stacked relationship onto the pre-heating roll 4 at 80° C where they were heated for 20 seconds and onto the heating roll 5 at 190° C where they were heated for 40 seconds during which transfer printing was effected on the textile material 2. The printed material 2 was separated from the other two materials 1 and 3 and passed onto the brushing roll 25 which was rotated at a peripheral velocity of 8 m/min. in view of the printed textile material moving at a velocity of 5 m/min. selected in this case. The printed textile material was passed onto the cooling roll 6 at 20° C where it was contacted with the roll surface for 10 seconds, and then passed to the take-up roll 7. The temperature of the printed polyester pilous textile material taken up on the take-up roll 7 was 38° C which was lower than its secondary transition point, and the printed pilous textile material was heat set in satisfactory pilous state with its pushed-down piles having been remedied by brushing to be raised erect.

For comparison, the procedure of Example 6 was followed except that the brushing roll was rotated at a peripheral velocity of 4.5 m. The results are that the printed, highly pilous polyester textile material taken up on the take-up roll was heat set in such state that the piles thereof were pushed down, and the heat-set textile material was attempted to be remedied to raise the pushed-down piles erect by manually brushing with a brush but this was little successful.

What is claimed is:

1. Apparatus for dyeing textile material in which the dye is transferred from transfer printing material to said textile material comprising a housing having a pressure therein of not higher than 100 mm of mercury, a heated roll within said housing, textile feeding means within said housing for feeding said textile material to said heated roll, transfer printing material feeding means in said housing for feeding said transfer printing material to said heated roll such that heating and transfer printing of the textile material is effected at said heating roll, a power driven cooling roll within said housing located downstream of said heated roll, said cooling roll cooling the heated and printed textile material to a temperature lower than its secondary transition point, a take-up roll in said housing located downstream of said cooling roll and on which the cooled, printed textile material is taken up, said cooling roll and said take-up roll being located closely adjacent to one another such that the printed and cooled textile material passes through the nip between said power driven cooling roll and said textile material take-up roll, said power driven cooling roll being in pressure contact with the printed and cooled textile material on said textile material take-up roll, and means for displacing said textile material take-up roll away from said cooling roll such that as the textile material take-up roll increases in diameter as additional printed and cooled textile material is taken up thereon, the textile material take-up roll moves away from said cooling roll to thereby provide continuous pressure contact of said cooling roll with the growing layer of printed and cooled textile material on said textile material take-up roll.

* * * * *

UNITED STATES PATENT AND TRADEMARK OFFICE

CERTIFICATE OF CORRECTION

PATENT NO. : 3,994,146
DATED : November 30, 1976
INVENTOR(S) : Yasuhiko MURASE

It is certified that error appears in the above-identified patent and that said Letters Patent are hereby corrected as shown below:

Under the heading "Foreign Application Priority Data" delete "Apr. 11, 1974 Japan .....49-40422".

Signed and Sealed this

Eighth Day of March 1977

[SEAL]

*Attest:*

RUTH C. MASON
*Attesting Officer*

C. MARSHALL DANN
*Commissioner of Patents and Trademarks*